US009601843B2

(12) United States Patent
Jarmuth

(10) Patent No.: US 9,601,843 B2
(45) Date of Patent: Mar. 21, 2017

(54) ACTUATING ELEMENT AND CONNECTING TERMINAL

(71) Applicant: PHOENIX CONTACT GMBH & CO. KG, Blomberg (DE)

(72) Inventor: Volker Jarmuth, Horn-Bad Meinberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/912,613

(22) PCT Filed: Aug. 20, 2014

(86) PCT No.: PCT/EP2014/067702

§ 371 (c)(1),
(2) Date: Feb. 18, 2016

(87) PCT Pub. No.: WO2015/024954

PCT Pub. Date: Feb. 26, 2015

(65) Prior Publication Data

US 2016/0197416 A1 Jul. 7, 2016

(30) Foreign Application Priority Data

Aug. 20, 2013 (DE) ..... 10 2013 108 952

(51) Int. Cl.
*H01R 4/24* (2006.01)
*H01R 4/48* (2006.01)
*H01R 9/24* (2006.01)

(52) U.S. Cl.
CPC ..... *H01R 4/4836* (2013.01); *H01R 9/2408* (2013.01)

(58) Field of Classification Search
CPC .. H01R 4/4845; H01R 4/4836; H01R 4/4827; H01R 4/4818; H01R 12/515; H01R 4/48; H01R 11/282
USPC ..... 439/441, 834, 835
See application file for complete search history.

(56) References Cited

U.S. PATENT DOCUMENTS

| | | | | |
|---|---|---|---|---|
| 7,896,685 | B2 * | 3/2011 | Eppe | H01H 1/5844 439/441 |
| 8,262,422 | B1 | 9/2012 | Chiang | |
| 8,444,443 | B2 * | 5/2013 | Schafmeister | H01R 4/4836 439/441 |
| 8,475,191 | B2 * | 7/2013 | Schafmeister | H01R 4/4836 439/266 |
| 2011/0209972 | A1 | 9/2011 | Eppe et al. | |

FOREIGN PATENT DOCUMENTS

| | | | |
|---|---|---|---|
| DE | 102010025930 | A1 | 1/2012 |
| WO | WO 2010034430 | A1 | 4/2010 |

* cited by examiner

*Primary Examiner* — Xuong Chung Trans
(74) *Attorney, Agent, or Firm* — Leydig, Voit & Mayer, Ltd.

(57) ABSTRACT

The invention relates to an actuating element (1) for actuating a clamping spring (8) of a connecting terminal, comprising: an actuating finger (2) which has an actuating surface (7) with which the actuating finger (2) presses onto a clamping limb (9) of the clamping spring (8) during actuation of the clamping spring (8); and a cover element (3) which forms an extension of the actuating finger (2) in the longitudinal direction of the actuating finger (2), the cover element (3) being laterally molded on the actuating finger (2).

7 Claims, 2 Drawing Sheets

ACTUATING ELEMENT AND CONNECTING TERMINAL

CROSS-REFERENCE TO PRIOR APPLICATIONS

This application is a U.S. National Phase application under 35 U.S.C. §371 of International Application No. PCT/EP2014/067702, filed on Aug. 20, 2014, and claims benefit to German Patent Application No. DE 10 2013 108 952.6, filed on Aug. 20, 2013. The International Application was published in German on Feb. 26, 2015 as WO 2015/024954 A1 under PCT Article 21(2).

FIELD

The invention relates to an actuating element for actuating a clamping spring of a connection terminal. The invention further relates to a connection terminal for connecting an electrical conductor which comprises an actuating element for actuating a clamping spring.

BACKGROUND

Connection terminals, also referred to as electrical connection terminals, usually comprise a housing, a busbar arranged in the housing and a clamping spring mounted in the housing. A conductor insertion opening is usually formed in the housing, via which opening a conductor can be inserted into the housing in order to be able to be clamped in the housing against the busbar by means of the clamping spring. If thin conductors, i.e. conductors having a small cross section, are intended to be clamped, an actuating element is usually provided, by means of which the clamping spring can be actuated in that the actuating element which protrudes into the internal space of the housing presses on the clamping leg of the clamping spring such that the clamping leg is swiveled and a conductor connection space inside the housing between the busbar and the clamping spring can thereby be released, into which space the conductor can then be inserted unimpeded. If the conductor is positioned in the desired position in the conductor connection space, the actuating element can release the clamping leg again so that the clamping leg can swivel back until it presses against the conductor and thus clamps the conductor against the busbar.

However, when the conductor to be clamped is inserted into the conductor connection space, incorrect placement of the conductor can easily occur if the thin conductor is guided laterally past the clamping spring and thus is no longer positioned in the conductor connection space between the clamping spring and the busbar. Clamping the conductor and thus forming an electrical contact can in this case only take place in a restricted manner or not at all.

SUMMARY

An actuating element for actuating a clamping spring of a connection terminal includes an actuating finger with an actuation surface that presses on a clamping leg of the clamping spring when the clamping spring is actuated. A cover element forms an extension of the actuating finger in a longitudinal extension of the actuating finger. The cover element is laterally moulded on the actuating finger.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
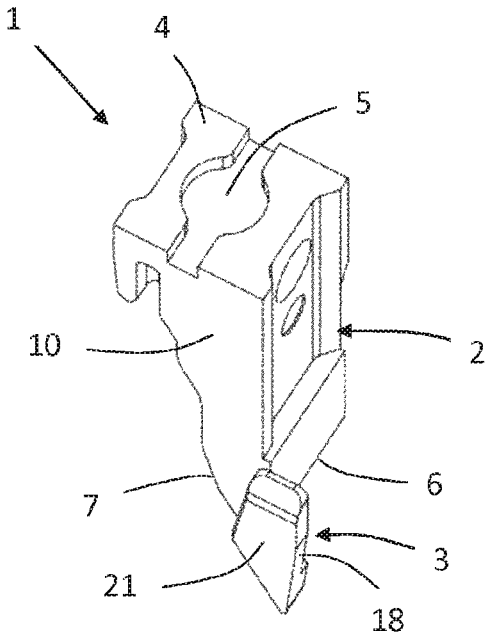
FIG. 1 is a schematic perspective view of an actuating element according to the invention.

The actuating element according to the invention, also referred to as the connection terminal actuating element, is characterised in that the actuating element has a cover element in addition to the actuating finger, which cover element is moulded on the end of the actuating finger and by means of which the actuating finger presses on the clamping leg of the clamping spring in order to actuate said leg. The cover element is laterally moulded on the actuating finger and thus moulded in a manner which is transverse to the actuation surface of the actuating finger, by means of which surface the actuating finger presses on the clamping leg of the clamping spring. The cover element thus increases the width of the actuating element where the cover element is arranged. In the longitudinal extension of the actuating finger, the cover element forms an extension of the actuating finger and thus overlaps the end of the actuating finger by means of which the actuating finger presses on the clamping leg of the clamping spring. The cover element can be laterally guided past the clamping spring, in particular the clamping leg of the clamping spring, due to the overlapping and the lateral formation of the cover element. Inside a connection terminal, the cover element, at least including one region of the cover element, can thereby enter a gap formed between the clamping leg of the clamping spring and a region of the housing of the connection terminal, in particular a housing cover of the housing, and close and/or seal said gap. Since the gap between the clamping leg of the clamping spring and a region of the housing of the connection terminal is now closed by the cover element, in particular if the clamping leg of the clamping spring is actuated by means of the actuating finger of the actuating element, a conductor, in particular a thin conductor, can be prevented from being laterally guided past the clamping leg of the clamping spring when the conductor is inserted into the conductor connection space of the connection terminal, as a result of which no more clamping and/or contact could be produced. Such an incorrect placement of a conductor in a connection terminal thus can be reliably prevented using the actuating element according to the invention.

The cover element is preferably planar, the planar cover element preferably having a thickness which basically corresponds to the width of the gap between the clamping leg of the clamping spring and a region of the housing of the connection terminal. Owing to the planar formation of the cover element, said element requires little space inside the connection terminal, meaning that the dimensions of the connection terminal are preferably not affected by the cover element.

In order to achieve a stable and secure arrangement of the cover element on the actuating finger of the actuating element, the cover element is preferably integrally moulded on the actuating finger. The actuating finger and the cover element are in this case preferably formed of a plastics material so that the actuating finger and the cover element, and thus the entire actuating element, can be produced in one processing step in an injection moulding process.

It is more preferably provided for the cover element to be moulded on a lower end of the actuating finger. The cover element thus preferably does not extend over the entire length of the actuating finger, but rather covers merely a portion of the actuating finger, at the lower, free end of the actuating finger, on which the actuation surface of the actuating finger is also formed. As a result, the amount of material required for producing the cover element can be reduced.

In order to achieve reliable sealing of the gap between the clamping leg of the clamping spring and a region of the housing, in particular a housing cover of the housing, it is preferably provided that the cover rests against a first side face on a region of the housing, in particular a housing cover of the housing, and rests against a second side face opposite the first side face on a transverse side face of the clamping leg of the clamping spring.

The cover element preferably has an edge face extending transversely to the two opposing side faces, which edge face is directed toward the conductor connection space, the cover element preferably resting, by means of an edge face, against a housing wall which delimits the conductor connection space of the connection terminal. Since an edge face of the cover element also rests flat on a housing wall of the housing, the sealing of the gap can be further improved. When the actuating element is moved, the cover element can be guided, by means of its edge face, along the housing wall which forms the conductor connection space, such that there can thus be additional, tilt-free guiding of the actuating element.

Figure 2:
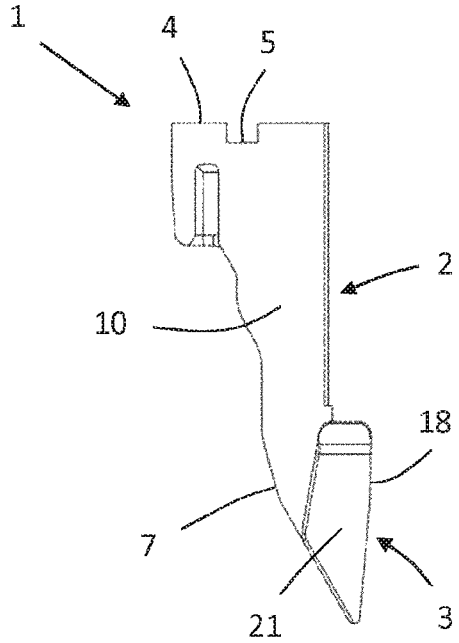
FIG. 2 is a schematic first side view of the actuating element shown in FIG. 1.
Figure 3:
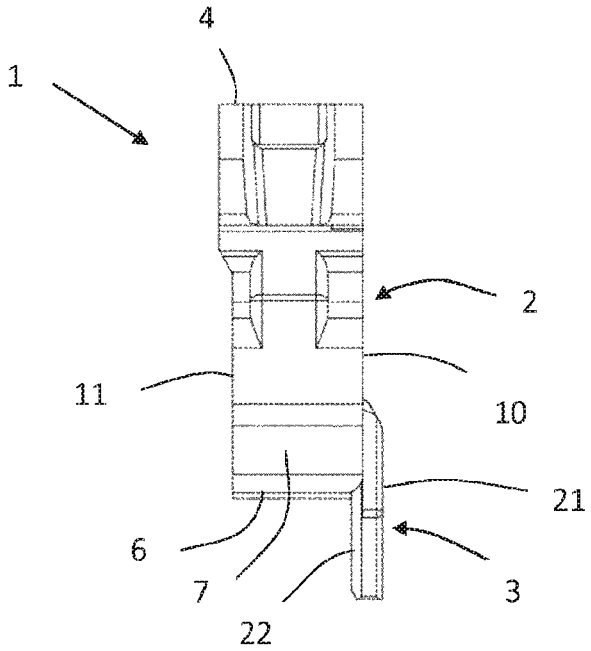
FIG. 3 is a schematic second side view of the actuating element shown in FIG. 1.

In FIG. 1-3, an actuating element 1 according to the invention is shown from different perspectives, the actuating element 1 comprising an actuating finger 2 and a cover element 3 arranged on the actuating finger 2.

The actuating finger 2 is elongate and has, on its upper end 4, an engagement face 5 for a tool, for example a screwdriver, by means of which the actuating element 1 can be moved inside the connection terminal.

At this upper end 4, the actuating finger 2 has a substantially square cross sectional area. The actuating finger 2 tapers off toward the lower end 6 of the actuating finger 2, which lower end is opposite the upper end 4, such that the cross sectional area of the actuating finger 2 is reduced toward the lower end 6.

Figure 4:
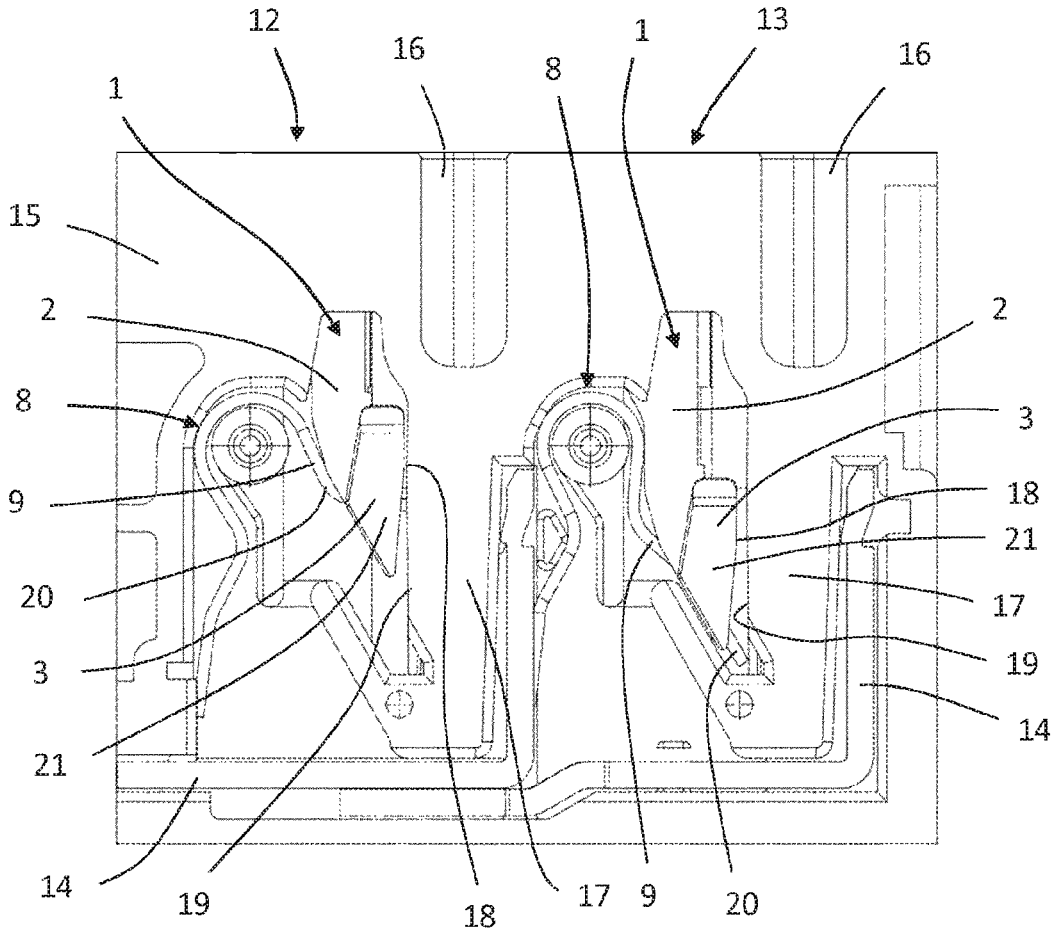
FIG. 4 is a schematic view of a connection terminal having two actuating elements designed according to FIG. 1-3, arranged in different positions.

Toward the lower end 6, the actuating finger 2 has an actuation surface 7 which extends over the width of the actuating finger 2 and by means of which the actuating finger 2 presses on a clamping leg 9 of the clamping spring 8 when a clamping spring 8 is actuated, as shown in FIG. 4.

The cover element 3 is moulded on a side face 10 of the actuation finger 2, which face is transverse to the actuation surface 7 of the actuation finger 2. In the embodiment shown, the cover element 3 is integrally moulded on the actuating finger 2. The cover element 3 is planar and projects beyond the lower end 6 of the actuating finger 2 such that the cover element 3 forms an extension of the actuating finger 2 in the longitudinal extension of the actuating finger 2, as can also be seen in particular in FIG. 3. The planar cover element 3 thus extends transversely to the actuation surface 7 and thus transversely to the width of the actuating finger 2.

When the clamping leg 9 of the clamping spring 8 is actuated, the cover element 3 is guided laterally past the clamping leg 9 and thus overlaps the clamping leg 9, as can also be seen in particular in FIG. 4.

In the embodiment shown, a cover element 3 of this kind is only arranged on one side face 10 of the actuating finger 2. However, it is also possible for one cover element 3 to be arranged on each of two opposing side faces 10, 11 of the actuating finger 2, such that, in the connection terminal, the clamping leg 9 of the clamping spring 8 is overlapped by a cover element 3 at two opposing transverse side faces.

FIG. 4 shows the arrangement of an actuating element 1 as shown in FIG. 1-3 in a connection terminal, the connection terminal shown in FIG. 4 having two connection regions 12, 13, which each have a clamping spring 8, an actuating element 1 and a busbar 14. The connection terminal has a housing 15 which is open on one side and can be closed using a housing cover, the housing cover being part of the housing 15 and thus forming a region of the housing 15. One conductor insertion opening 16 is arranged in the housing 15 for each connection region 12, 13, via which opening a conductor can be inserted into the connection terminal. One conductor connection space adjoins each of the conductor insertion openings 16 respectively inside the connection terminal, inside which space the inserted conductor can be clamped against the busbar 14 by means of the clamping leg 9 of the clamping spring 8. In the embodiment shown in FIG. 4, the conductor connection space is delimited on one side by a housing wall 17 of the housing 15, the housing wall 17 being arranged so as to be laterally offset relative to the clamping leg 9 of the clamping spring 8 and the busbar 14.

The cover element 3 has an edge face 18, by means of which the cover element 3 rests flat on the housing wall 17, the cover element 3 being able to be guided, by means of its edge face 18, along a side face 19 of the housing wall 17 facing the clamping spring 8, when the actuating element 1 is moved.

The actuating element 1 is shown in different positions in the two connection regions 12, 13. In the case of the connection region 12 shown on the left, the actuating element 1 is in a non-actuated initial position. If a conductor, in particular a thin conductor having a small cross sectional area, is now to be inserted into the conductor connection space and clamped, the actuating element 1, as can be seen in the connection region 13 shown on the right, is moved down such that the actuating finger 2 presses on the clamping leg 9 of the clamping spring 8 and thus swivels said leg down away from the busbar 14, in order to release the conductor connection space so that the conductor can be introduced into the conductor connection space. In both positions, the cover element 3 overlaps a transverse side face 20 of the clamping leg 9, which forms the thickness of the clamping leg 9, in that the cover element 3 protrudes beyond said transverse side face 20. Owing to the overlapping of the transverse side face 20 of the clamping leg 9 by the cover element 3, the cover element 3 is arranged, at least in regions, in a gap formed between the clamping leg 9 and the housing cover of the housing 15 in such a way that said gap is sealed by the cover element 3 and thus the conductor can be prevented from being guided laterally past the clamping leg 9 when inserted into the conductor connection space.

The cover element 3 thus rests with a first side face 21 against the housing cover of the housing 15 and rests with a second side 22 face opposite the first side face 21 against the transverse side face 20 of the clamping leg 9, the clamping leg 9 preferably pressing, by means of its transverse side face 20, on the second side face 22 of the cover element 3 and thus the cover element 3 being pressed, by means of its first side face 21, against the housing cover of the housing 15 in such a way that a particularly good sealing effect is achieved.

By means of the above-described embodiment of the actuating element 1, the actuation surface 7, by means of which the actuating finger 2 rests against the clamping leg 9, can also be increased.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Actuating element 1
Actuating finger 2
Cover element 3
Upper end 4
Engagement face 5
Lower end 6
Actuation surface 7
Clamping spring 8
Clamping leg 9
Side face 10
Side face 11
Connection region 12, 13
Busbar 14
Housing 15
Conductor insertion opening 16
Housing wall 17
Edge face 18
Side face 19
Transverse side face 20
First side face 21
Second side face 22

The invention claimed is:

1. An actuating element for actuating a clamping spring of a connection terminal, the actuating element comprising:
- an actuating finger including an actuation surface configured to press on a clamping leg of the clamping spring when the clamping spring is actuated and a first side face that is transverse to the actuation surface; and
- a cover element which forms an extension of the actuating finger in a longitudinal extension of the actuating finger,
- wherein the cover element is laterally moulded on and projects beyond the first side face of the actuating finger.

2. The actuating element of claim 1, wherein the cover element is planar.

3. The actuating element of claim 1, wherein the cover element is integrally moulded on the actuating finger.

4. The actuating element of claim 1, wherein the cover element is laterally moulded on a lower end of the actuating finger.

5. A connection terminal for connecting an electrical conductor, the connection terminal comprising:
- a housing;
- a clamping spring; and
- the actuating element including:
  - an actuating finger including an actuation surface configured to press on a clamping leg of the clamping spring when the clamping spring is actuated and a first side face that is transverse to the actuation surface; and
  - a cover element which forms an extension of the actuating finger in a longitudinal extension of the actuating finger,
  - wherein the cover element is laterally moulded on and projects beyond the first side face of the actuating finger, and
- wherein the cover element moulded on the actuating finger of the actuating element is arranged, at least in regions, in a gap formed between the clamping leg of the clamping spring and a region of the housing.

6. The connection terminal of claim 5, wherein inside the gap the cover element rests with a first cover element side face against the region of the housing and rests with a second cover element side face, which is opposite the first cover element side face, against a transverse side face of the clamping leg of the clamping spring.

7. The connection terminal of claim 5, wherein the cover element has an edge face which rests against a housing wall which delimits a conductor connection space of the connection terminal.

* * * * *